United States Patent [19]

Premi et al.

[11] Patent Number: 4,570,427

[45] Date of Patent: Feb. 18, 1986

[54] APPARATUS FOR SPLICING TEXTILE THREADS

[75] Inventors: Mauro Premi, Saló; Gianfranco Guzzoni, Puegnago, both of Italy

[73] Assignee: Mesdan S.p.A., Saló, Italy

[21] Appl. No.: 615,304

[22] Filed: May 30, 1984

[30] Foreign Application Priority Data

Jun. 3, 1983 [IT] Italy ..... 21455 A/83
Oct. 7, 1983 [IT] Italy ..... 23202 A/83

[51] Int. Cl.[4] ..... D01H 15/00
[52] U.S. Cl. ..... 57/22; 57/261
[58] Field of Search ..... 57/22, 261, 263

[56] References Cited

U.S. PATENT DOCUMENTS 4,437,299 3/1984 Truzzi ..... 57/22
4,494,366 1/1985 Deno ..... 57/22
4,494,368 1/1985 Mima ..... 57/263 X
4,499,715 2/1985 Kaisha ..... 57/22
4,507,912 4/1985 Noguchi ..... 57/22

*Primary Examiner*—Donald Watkins
*Attorney, Agent, or Firm*—Cushman, Darby & Cushman

[57] ABSTRACT

The invention relates to an apparatus for splicing textile threads by means of compressed air in a mixing chamber, with a device for pretreating the ends of the threads which comprises nozzles controllably feedable with compressed air and arranged at the sides of the body in which the mixing chamber is defined. The jets of air caused to leave the nozzles interfere with the cut ends of the threads laterally leaving the mixing chamber and cause them to be subjected to flapping and to a free whipping for opening and separating the fibres and putting the latter parallel to each other. A whirling motion may be imparted to the jets of air to remove the original twist from the fibres.

20 Claims, 22 Drawing Figures

APPARATUS FOR SPLICING TEXTILE THREADS

Figure 1:
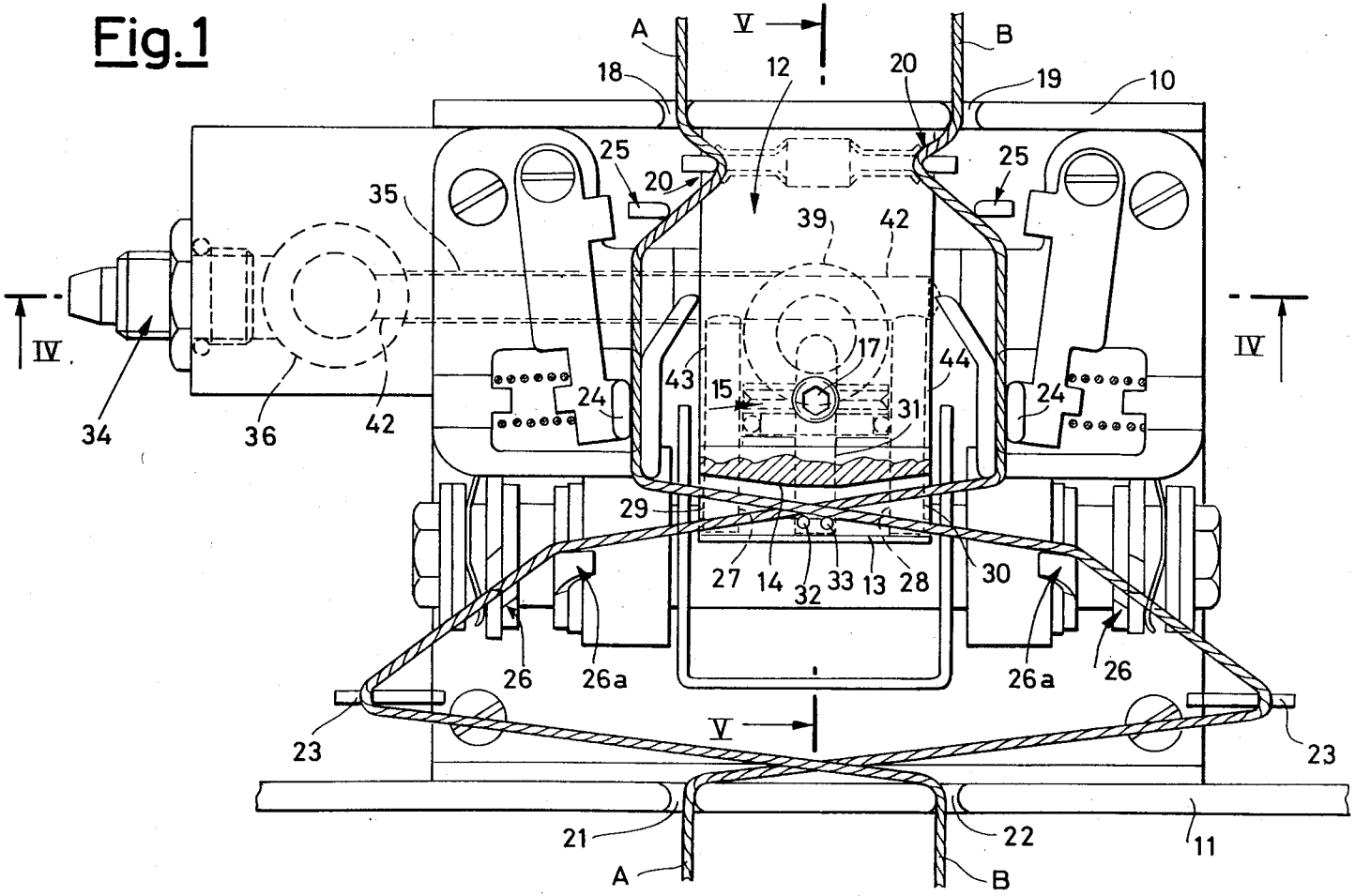

The present invention relates to an apparatus for splicing textile threads by means of compressed air with a device for dressing the ends of the threads to be spliced.

In the art of splicing textile threads or yarns using compressed air to be carried out in a suitable mixing chamber having a proper form which may be closed frontally by a lid and is laterally open and in which the ends of the threads to be spliced are positioned and into which lead one or more compressed air outlets for the inlet of air in form of jets over a preestablished time, it is known that it is convenient to pretreat the ends of the threads or yarns to be spliced in order to obtain mixing, interlacing and winding of the fibres of the two threads and thus their splicing. This pretreatment has the purpose to open and separate the fibres and put them in a parallel relationship to one another in the end portion of the threads while causing them to lose the original twist, so that subsequent mixing, mutual interlacing and winding of the fibres of the two threads to be spliced is made easier and a splice can finally be obtained which has a good mechanical strength and an optimal appearance.

Splicing apparatus have therefore been provided with a suitable device for pretreating the ends of the threads. Particularly, devices of this kind have been proposed which comprise small tubes arranged at the two sides of the body in which the mixing chamber of the splicing apparatus is defined. In the small tubes the cut ends of the two threads to be spliced are introduced for being treated in the inside of the tubes themselves by means of air blows directed against them. Each of these tubes is therefore provided with at least one inclined nozzle through which air is blown into the tube such as to produce in the inside thereof a depression which is capable of sucking the cut end of the respective thread, while the air stream produced in the tube causes the fibres of the thread to open and separate from one another.

This known system for pretreating the ends of the threads to be spliced in suitable tubes in which an air current is produced involves however certain difficulties and drawbacks. Apart from problems originating from the overall dimensions and space occupied by said tubes and from difficulties relating to the sure introduction of the ends of the fibres by suction through suitable slots provided in the tubes, there are other problems relating to the metering of the rate of air to be blown into the tubes and to the duration of the treatment according to the characteristics of the threads, as well as relating to the verified convenience of avoiding the formation of a whirling air current in the inside of the tubes to prevent undesired excessive removal of fibres and to the necessity of controlling and predetermining the length of the thread portion in which the fibres open and become arranged parallel to one another.

To partially obviate the above shortly mentioned drawbacks and difficulties applicants have recently proposed to use, for the pretreatment of the cut ends of the threads to be spliced, small tubes in which elements elongated in an axial direction are inserted, which elements are freely movable within the respective tubes and can begin to vibrate as air is let into the tubes themselves.

Thanks to this measure it is possible to considerably improve the effectiveness of the pretreatment of the ends of the threads, however the problems relating to the arrangement of the pretreatment tubes in the splicing apparatus and to the overall dimensions thereof as well as the difficulties and the uncertainty due to the necessity of introducing the cut ends of the threads by suction through the proper slots provided in the tubes have remained unchanged with respect to the previously suggested approaches.

The object of the present invention is to provide, in an apparatus for splicing by means of compressed air, a device for pretreating the cut ends of threads which while assuring an effective opening, separation and parallel arrangement of the fibres in the end portions of the threads, achieves this result with greater security and with simpler means without involving dimensional problems.

To achieve this object there is proposed, according to the present invention, a device for dressing the ends cut by means of suitable cutting members of the threads to be spliced by means of compressed air in the mixing chamber defined in a body of a splicing apparatus, characterized in that it comprises, adjacent each side of said body in which the mixing chamber is defined, at least one nozzle connectable through a valve with a source of compressed air to emit a jet of compressed air in a direction away from the respective side of said body, the axis of said nozzle being directed in such a way that it substantially intersects the straight line connecting the lateral outlet of the mixing chamber with the cutting member corresponding to the respective side of said body in the position ready for cutting.

These jets of compressed air caused to leave the nozzles arranged at the sides of the body in which there is defined the mixing chamber act on the cut ends of the threads beforehand introduced in the mixing chamber, namely on the ends which get out laterally of the same chamber, so that these ends of the threads are caused to freely flap in the current of air and are subjected to a whipping that has the effect of opening and separating the fibres and arranging them parallel to each other.

The pretreatment of each end of the thread does not occur therefore in the inside of a small tube or anyhow in a limited environment as it occurs in the prior art, but in a free current of air which acts on the end of the thread and causes the same to be subjected therefore to a strong flapping which causes the desired opening of the fibres.

It is therefore apparent that this new system for pretreating the ends of the fibres to be spliced does not only allow to do away with the cumbersome tubes at the sides of the body in which there is defined the mixing chamber, but above all does not require that the ends of the threads are brought inside these tubes and therefore in the current of air flowing through the tubes themselves, the jets of air freely delivered from the nozzles providing instead themselves and automatically for interfering with the ends of the threads and causing the same to be subjected to a whipping effect. The problems as to dimensions are therefore solved and a considerably greater security is achieved.

For strengthening the action of said air jets onto the ends of the threads even in the case of greatly twisted threads which involve therefore difficulties as to opening and parallelization of the own fibers, the invention provides, in an advantageous embodiment, a suitable conditioning of the air jets caused to leave the nozzles, in the sense of imparting to the same jets a whirling movement such as to assist in opening the fibres while removing the original twist from the threads. To this purpose conditioning means are provided which are capable of imparting to the jets of compressed air leaving the pretreating nozzles a whirling movement having a rotational direction opposite to the twist direction of the thread intended to be hit by the air jets.

These conditioning means for the air jets may be arranged outside of the nozzles from which the jets come out and may be defined by semicylindrical walls against which the respective jets leaving the nozzles are directed in an oblique direction, so that a rotational movement is induced in the same which has a direction contrary to the twist direction of the respective thread, the free end of which during the treatment with the so conditioned air jet is partially surrounded by said semicylindrical wall.

Said conditioning means for the air jets may however also be arranged within the nozzles from which the jets themselves come out, and in this case said means may be defined by a helical element located inside the nozzle and capable of imparting to the jet still inside the nozzle a rotational movement which the jet maintains along a given stroke even after it has left the nozzle.

With such a conditioning of the air jets and the consequent vorticity of the air currents directed against the threads it is possible to remove the original twist thereof and opening and parallelization of the fibres can be made easier even in the case of greatly twisted threads.

Feeding of the pretreating nozzles with compressed air beings, after insertion of the two threads to be spliced into the mixing chamber of the splicing apparatus, substantially either at the time in which the cutting members cut the tails of the threads themselves or advantageously even an instant prior to this cut to surely guarantee interference of the cut ends of the threads with the air jets delivered by said nozzles, while the duration of the pretreatment of the ends of the threads in the air currents depends from the textile characteristics of the threads themselves.

In this connection it should also be observed that according to the characteristics of the threads to be treated it is possible to use jets of various sections or more than one nozzle such as for instance a main nozzle and secondary nozzles also having different orientation. It is also possible to use nozzles of different type adjacent the two opposite sides of the body in which the mixing chamber is defined, and furthermore it is possible to adjust the power of the air jets.

In splicing apparatus for textile threads the mixing chamber is advantageously machined within a body mounted in the cap of the apparatus in order to be easily interchangeable. In this case the apparatus may be provided with a plurality of said bodies having mixing chambers of different section and form eventually with a different arrangement of the inlet opening(s) for the compressed air for the purpose of adapting the apparatus to different requirements given by the threads to be spliced according to their textile characteristics.

According to a preferred embodiment of the device for pretreating the ends of the threads of the present invention it is foreseen to machine the nozzles for the pretreatment of the ends of the threads in the same interchangeable body in which the mixing chamber is defined: in this way adaptation of the splicing apparatus to the requirements of different types of threads is made more easy. In fact each of said interchangeable bodies may have both a mixing chamber and pretreating nozzles specific for a given type of thread.

This arrangement of the pretreating nozzles in the same body in which the mixing chamber is machined involves also further advantages as to constructional simplicity and space reduction, in that it does not require positioning, adjacent the sides of the body in which the mixing chamber is defined of distinct pretreating nozzles with respective supplying conduits for the compressed air. In this case the pretreating nozzles are reduced in practice to lateral outlets of suitable channels machined in the body in which the mixing chamber is defined, said channels being connected through other channels machined in the cap of the apparatus to the valve which controls inlet of compressed air. Obviously these channels have to be separate from that or those channels which on control of another valve cause inlet of compressed air into the mixing chamber.

Figure 2:
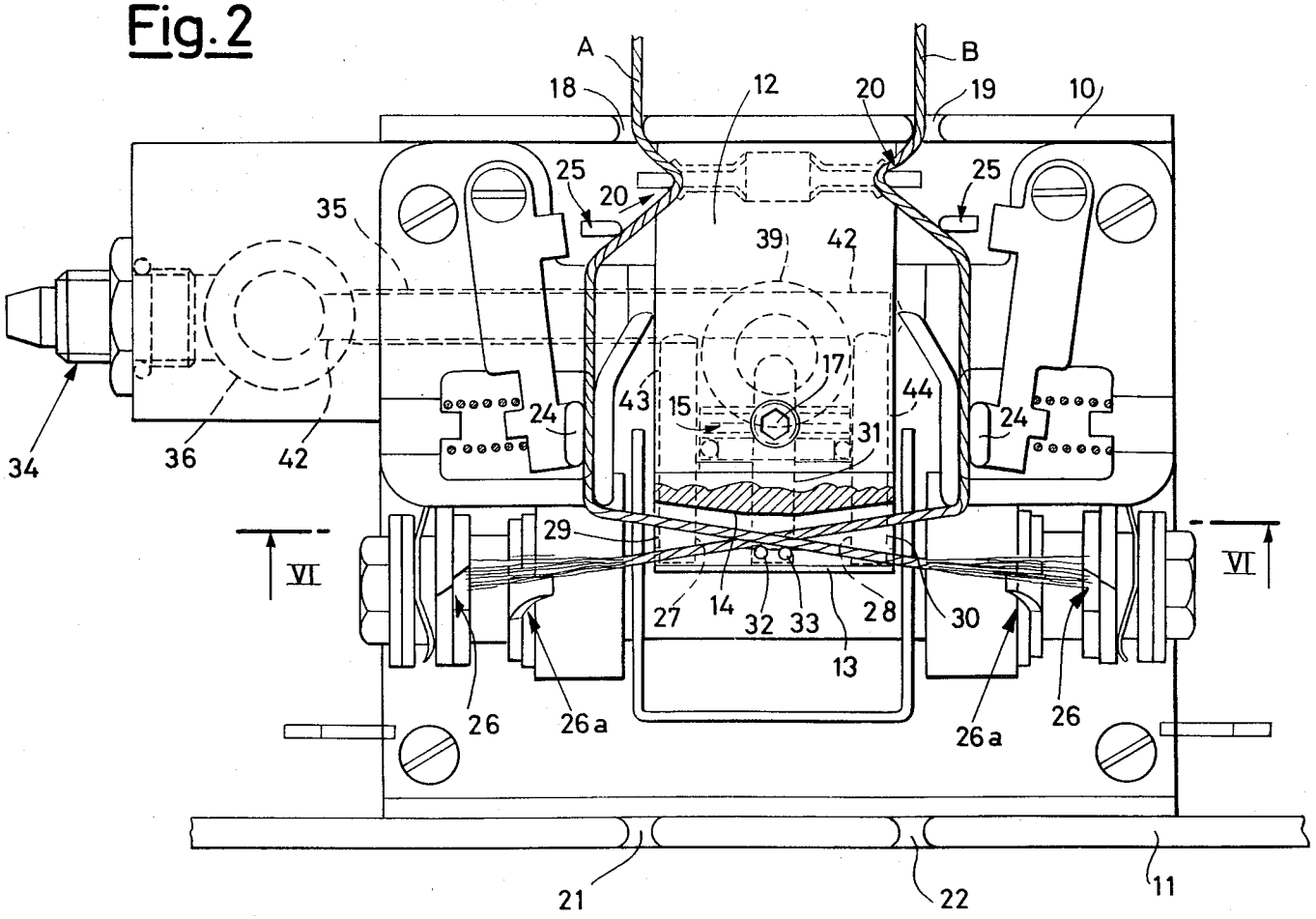
Figure 3:
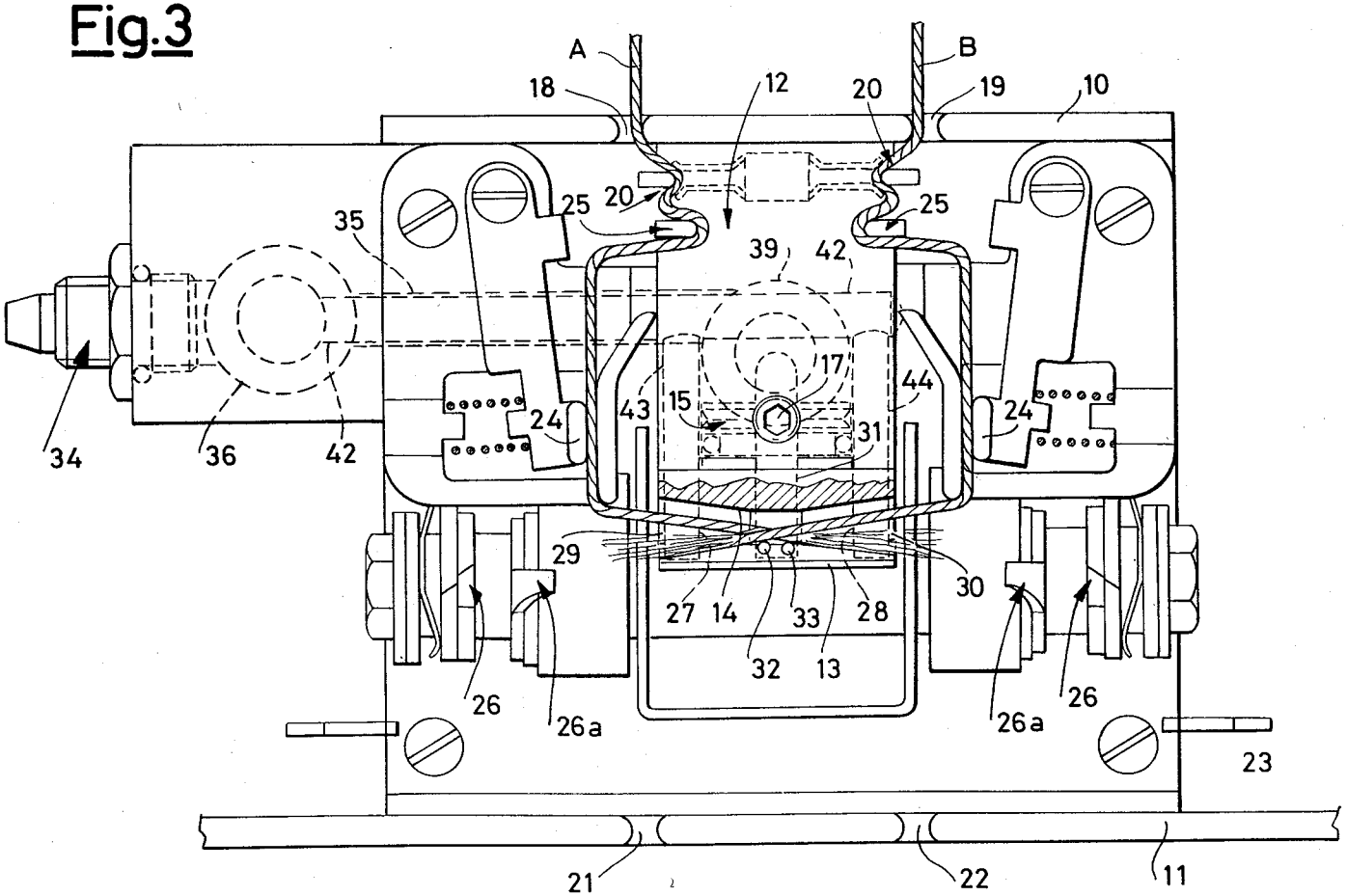
Figure 4:
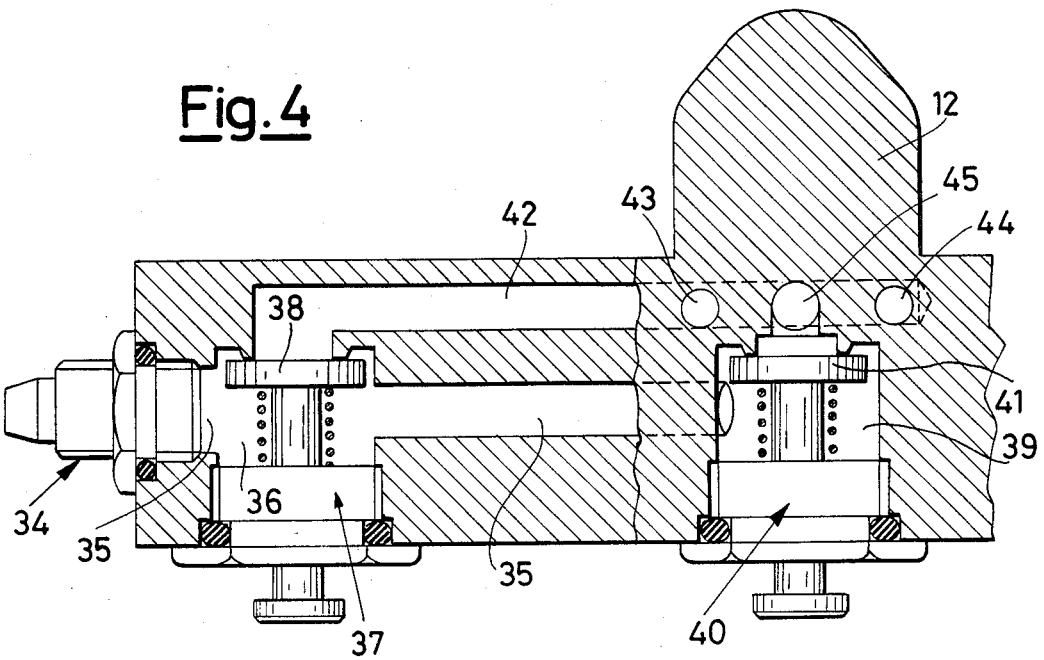
Figure 5:
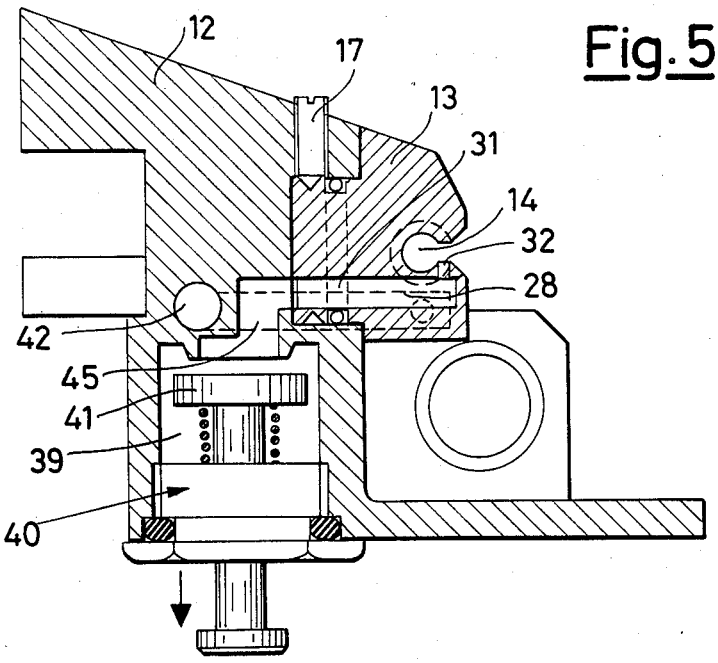
Figure 6:
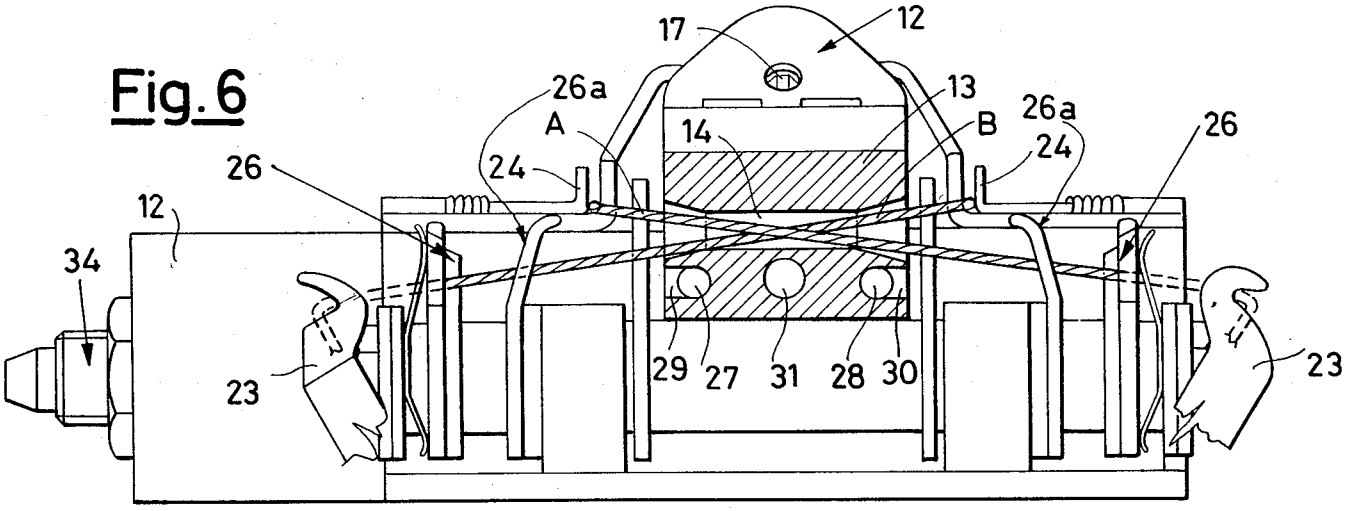
Figure 7:
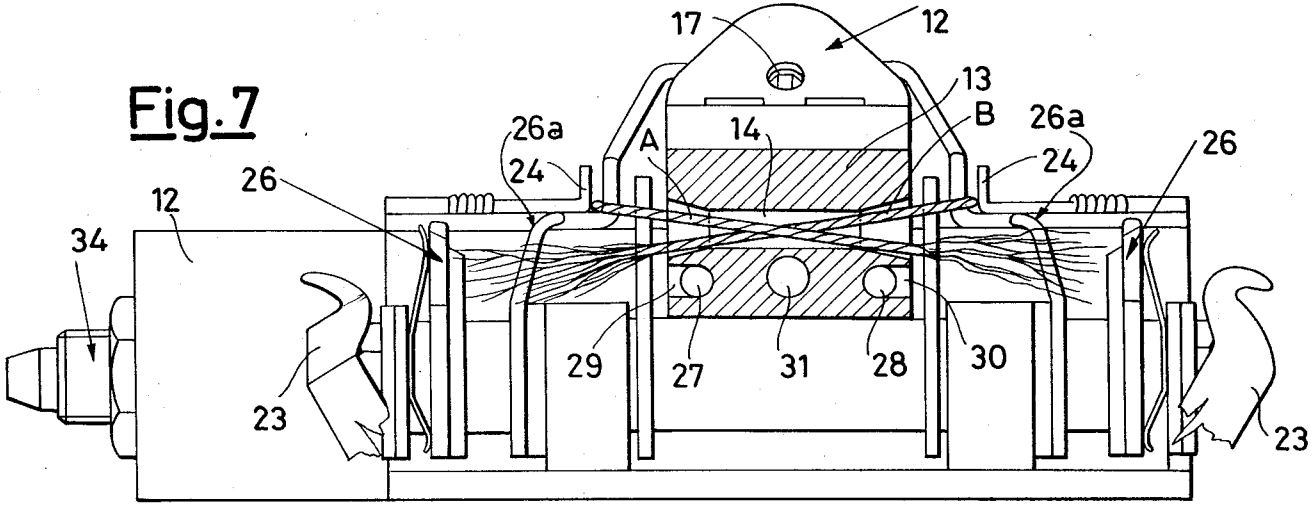
Figure 8:
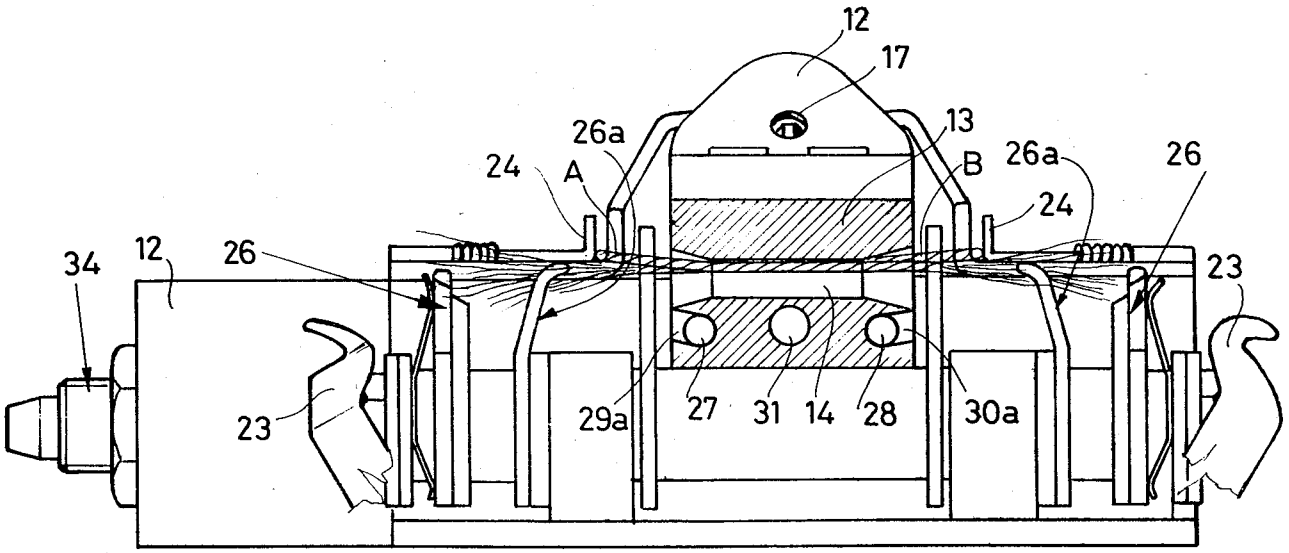
Figure 15:
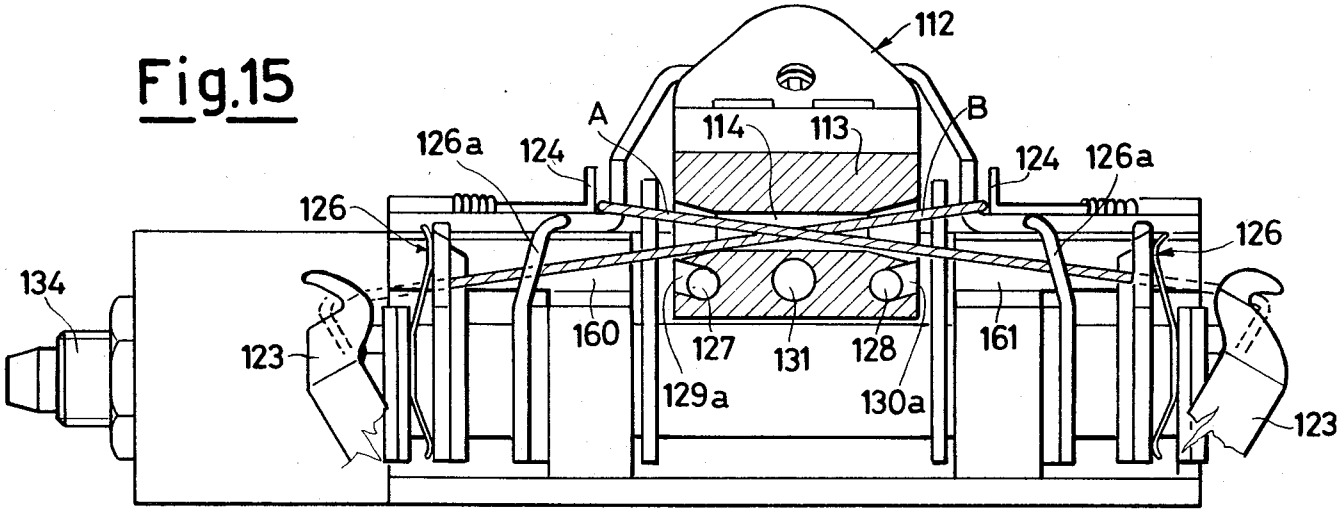
Figure 16:
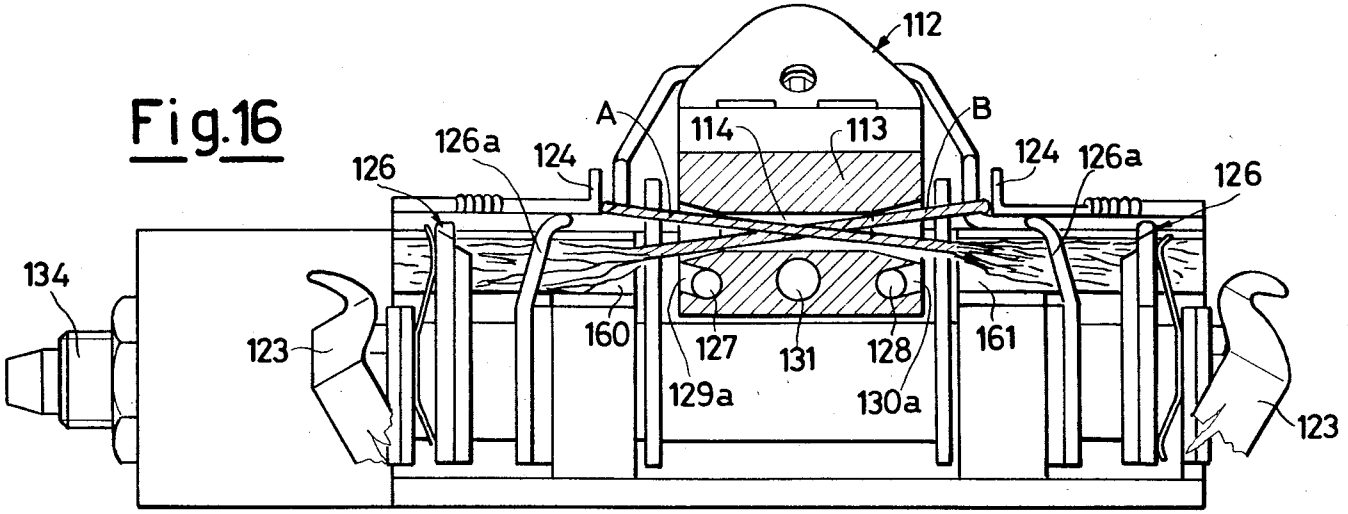
Figure 17:
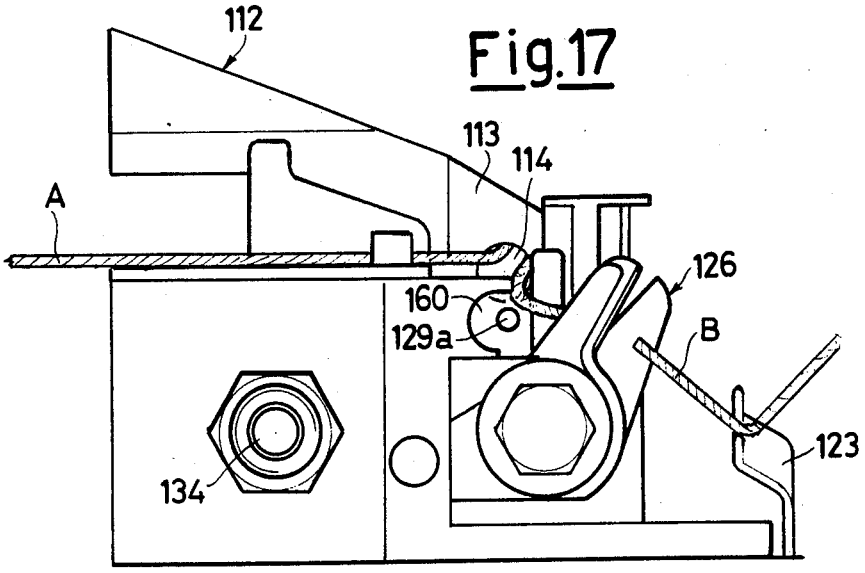
Figure 18:
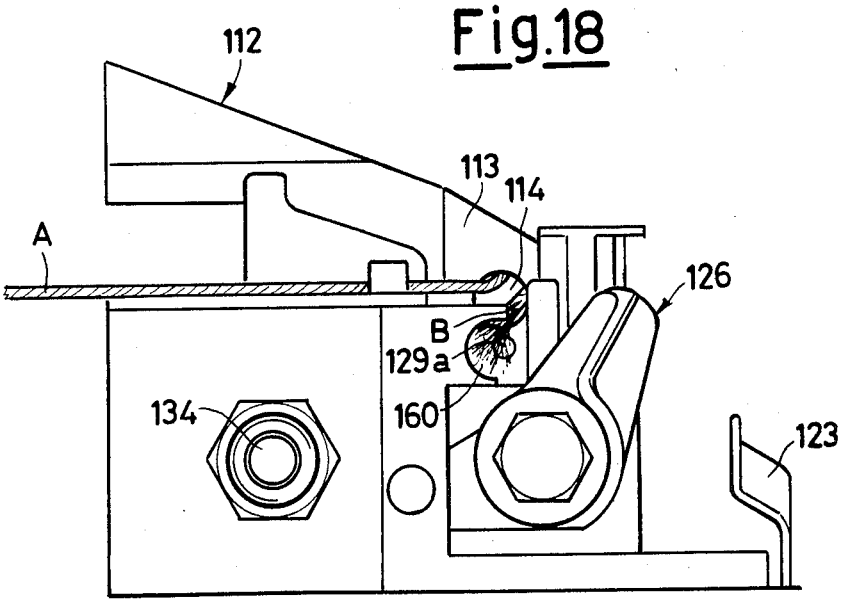
Figure 19:
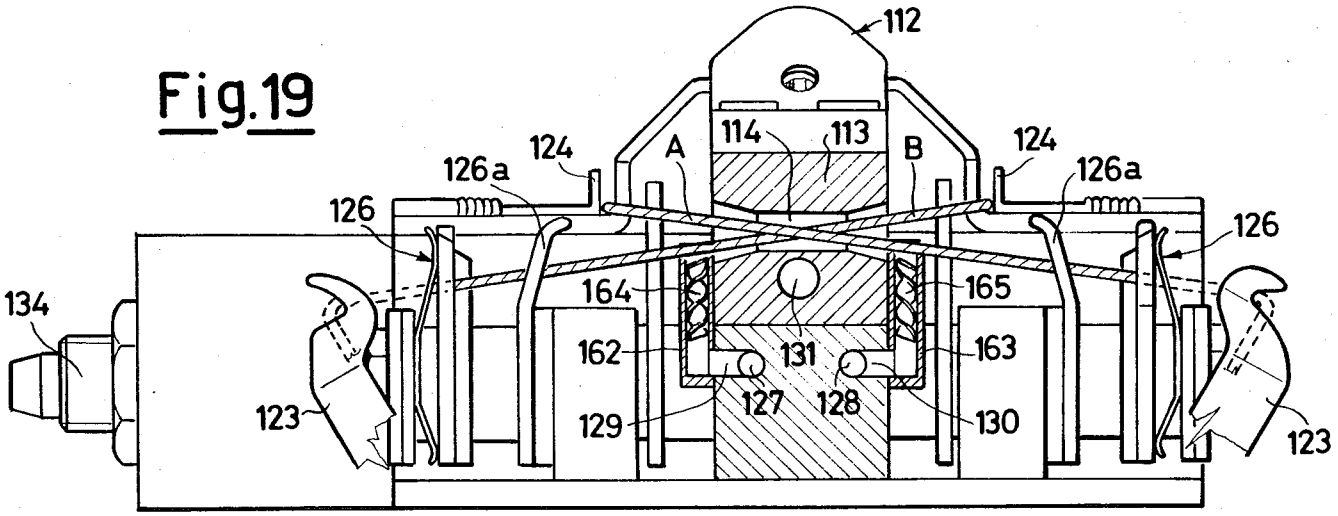
Figure 20:
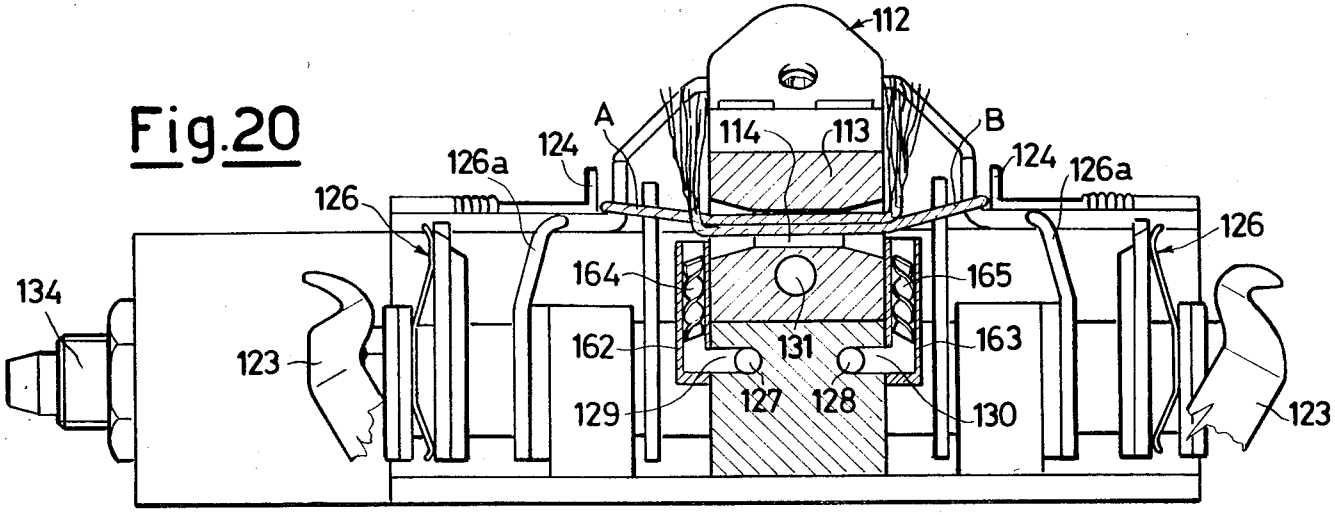
Figure 21:
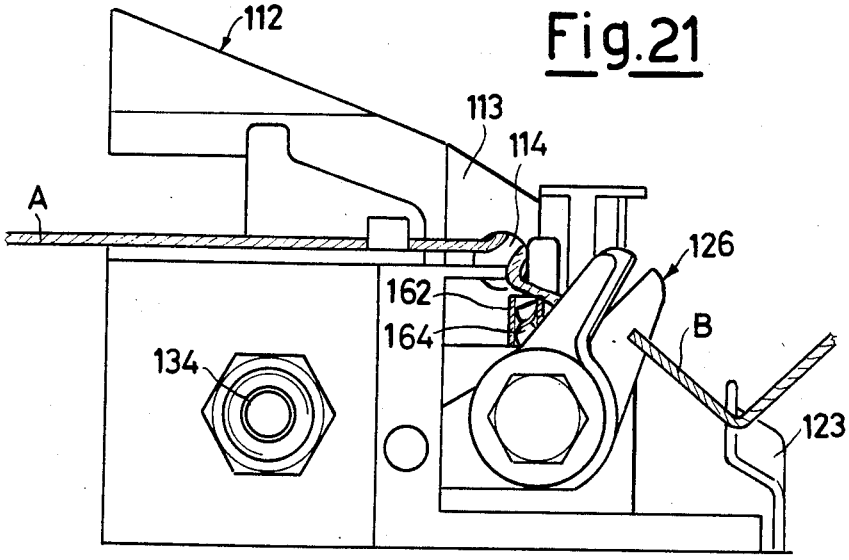
Figure 22:
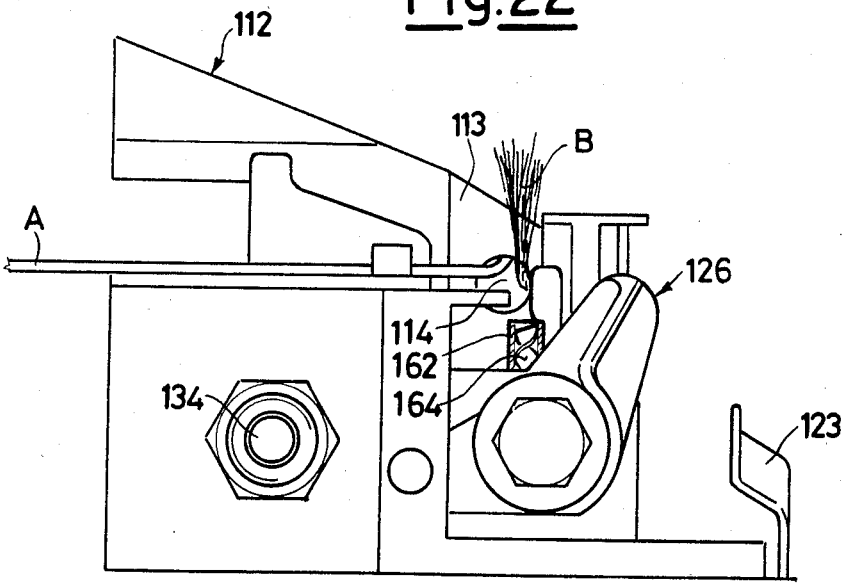

The invention will be described with greater details later on, having reference to the accompanying drawings which schematically illustrate an exemplary embodiment of an apparatus for splicing textile threads by means of compressed air with a device for pretreating the ends of the threads, and specifically:

FIGS. 1, 2, 3 represent schematical top plan views of the apparatus in subsequent operational steps, FIG. 4 is a vertical longitudinal section according to section line IV—IV of FIG. 1, FIG. 5 is a vertical cross section according to section line V—V of FIG. 1, FIG. 6 is a vertical longitudinal section according to section line VI—VI of FIG. 2 in the step in which cutting of the tails of the threads has just occurred, FIG. 7 is a section like that of FIG. 6, but during the pretreating step of the cut ends of the threads, FIG. 8 is a section like that of FIG. 7, but with a different orientation of the pretreating nozzles, FIGS. 9 to 14 show lateral views of some examples of bodies with mixing chambers and various forms and arrangements of pretreating nozzles, FIGS. 15 and 16 show like FIGS. 6 and 7 a further embodiment of the pretreating device in two different operational steps, FIGS. 17 and 18 show the device respectively in the steps represented in FIGS. 15 and 16 seen from the left side, and FIGS. 19 to 22 show like FIGS. 15 to 18 still another embodiment of the device.

The apparatus for splicing or joining textile threads or yarns by means of compressed air is well known per se in the art, so that only some essential parts thereof are illustrated and will be described in the following to facilitate understanding.

The various members of the apparatus are contained and supported between two plates 10, 11. A block or cap 12 arranged between the two plates carries an interchangeable body 13 in which there is machined the mixing chamber 14. The body 13 is inserted in an airtight manner with a rear portion 15 thereof in a corresponding seat 16 of the cap 12 and can be locked by means of a screw 17. The means for letting in compressed air into the mixing chamber will be described later on.

The plate 10 has splits 18, 19 for positioning the two threads to be spliced, indicated at A and B, and adjacent said plate 10 there are provided clamping members 20 for the two threads. The other plate 11 also has two splits 21, 22 for positioning the threads and in the region of the plate 11 there are mounted crossing members 23. The two threads A and B which have to be spliced are initially introduced into the splits 18 and 21 (thread A) and into the splits 19 and 22 (thread B), parallel to each other at the sides of the body 13, and owing to the action of the crossing members 23 and the clamping members 20 they assume a crossed position inside the mixing chamber 14 defined in the body 13, as visible in FIG. 1. In that position the threads A and B are further more held slightly clamped by other resilient clamping members 24, released by a first reciprocal approaching movement of means 25 for adjusting the length of the tails of the threads. The latter means 25 act on the threads A and B at a point lying between the clamping members 20 and their portion entering into the mixing chamber.

Pairs of positioning members 26*a* for the threads and cutting members 26 for cutting the free tails of the threads are further provided, said members 26 and 26*a* being arranged at the sides of the body 13. The cutting members 26 comprise each a fixed blade and a movable blade, the latter being pivotable in the shown case. The fixed blade and the movable one of each cutting member act like scissors.

For pretreating the ends of the threads A and B prior to their splicing by means of compressed air in the mixing chamber 14 there are provided, adjacent the sides of the body 13 in which there is defined the mixing chamber 14, nozzles which can be supplied with compressed air to deliver jets of air directed away from the sides of the body 13 and oriented in such a way that they substantially intersect the straight lines connecting the lateral outlets of the mixing chamber with the respective cutting members 26 in the position ready for cutting.

Specifically, in the illustrated embodiment, the body 13 in which there is defined the mixing chamber 14 is provided in its lowerpart with two lateral dead bores 27 and 28 (see FIG. 1) having parallel axes perpendicular to the longitudinal axis of the chamber 14, said bores 27 and 28 freely opening at the rear side of the body. From each of these dead bores 27 and 28 there extends laterally at least one bore 29 and respectively 30, which freely ends at the respective side of the body. The latter bores 29, 30, the axes whereof are oriented such as to substantially intersect the straight lines connecting the lateral outlets of the mixing chamber 14 with the respective cutting members 26 in cutting position, define the pretreating nozzles for the ends of the threads A and B (see also FIG. 6).

In the central lower part of the body 13 there is provided a further dead bore 31, which extends in the rear part 15 of the same body and freely opens at the rear side of said part 15; this bore 31 is parallel to the bores 27 and 28 and serves for supplying compressed air to the mixing chamber 14 through small bores 32 and 33.

For supplying compressed air either to the bores 27 and 28 and thus to the pretreating nozzles 29, 30 or to the bore 31 and therefore into the mixing chamber 14 there are provided in the block or cap 12 two distinct valves and suitable connecting channels which will be described later on with particular reference to FIGS. 1, 4 and 5.

The cap 12 is provided with a fitting 34 for connection to a source of compressed air, not shown. From this fitting 34 there extends a channel 35 which ends into the chamber 36 of a first valve 37 with movable shutter 38. From the chamber 36 the channel 35 continues and finally ends into the chamber 39 of a second valve 40 with movable shutter 41.

The movable shutter 38 of the first valve 37 is capable of either shutting off or opening passage of compressed air from chamber 36 into a conduit 42, from which two bores 43 and 44 extend perpendicularly to the axis thereof, the bores 27 and 28 of the body 13 when the latter is mounted on the cap 12.

On the contrary, the movable shutter 41 of the second valve 40 is capable of either shutting off or opening passage of compressed air from the chamber 39 into a conduit 45 which communicates with the bore 31 of the body 13 when the latter is mounted on the cap 12.

It is to be pointed out that the channel 35 and the chamber 36 and respectively 39 of the two valves 37 and 40 are always filled with compressed air coming from a respective source through the fitting 34, so that by opening the valve 37, i.e. lowering the movable shutter 38 thereof, compressed air reaches through the conduit 42 and the bores 43, 44, 27, 28 the pretreating nozzles 29 and 30, while by opening the valve 40, i.e. lowering the movable shutter 41 thereof, compressed air reaches through the conduit 45 and the bore 31 with the small bores 32, 33 the mixing chamber 14.

Obviously, opening control for the two valves 37 and 40 which are normally held in a shutting off position by respective resilient means occurs by means of proper members of the apparatus (not shown) synchronously with the subsequent operational steps of the apparatus.

The operation of the splicing apparatus and the pretreating device for the ends of the threads to be spliced is as follows. After positioning of the two threads A and B to be spliced as shown in FIG. 1, with the threads already crossing each other in the mixing chamber 14 and locked by the clamping members 20 and by the locking members 24, the cutting members 26 become operative to cause cutting of the free tails of the threads themselves at the side of the plate 11 (see FIG. 6).

Simultaneously with the cutting of the tails or even an instant before, opening of the valve 37 is controlled, whose movable shutter 38 lowers to allow passage of compressed air towards the lateral pretreating nozzles 29, 30 which open at the sides of the body 13. Jets of air therefore come out from these nozzles in opposite direction of the body 13. The free cut ends of the two threads A and B are hit and intercepted by these jets of air and are therefore subjected to a flapping action providing a whipping effect (see FIGS. 2 and 7) along the whole portion thereof which gets out laterally from the mixing chamber 14. Thanks to this free flapping the current of air the fibres of the threads in the portion outside the mixing chamber become opened, separated and put parallel to each other. Duration of this pretreating step is conveniently preestablished according to the characteristics of the threads to obtain the desired result without excessive loss of fibres.

Upon completion of the pretreating operation of the ends of the threads, valve 37 is newly shut off and compressed air supply to the pretreating nozzles 29 and 30 is therefore interrupted.

Subsequently the members 25 are newly controlled in the sense of a greater mutual approach thereof and thus of a lengthening of the path of the two threads A and B, so that their pretreated ends are withdrawn into the mixing chamber 14, as indicated in FIG. 3.

Upon obtaining such positioning, splicing operation proper is carried out now controlling opening of the valve 40 and consequent letting in of compressed air into the mixing chamber 14 through the conduit 45, the bore 31 and the small bores 32 and 33.

In the shown case the splicing apparatus is provided with a mixing chamber without frontal closing lid, but it will be understood that such a lid may be provided if required or desired.

From the above description it is clear how pretreating of the ends of the threads to be spliced is carried out upon introduction of the threads themselves into the mixing chamber and cutting of the free tails by subjecting the ends of the threads laterally getting out from the mixing chamber to the free action of jets of air delivered by suitable nozzles in the region of the sides of the body in which there is machined the mixing chamber. These jets of air act in practice on the whole length of the ends of the threads externally of the mixing chamber: the jets of air, even if they do not hit exactly the ends of the threads, capture all the same automatically these ends without the need that the same be exactly intersected by the jets of air, which thus provide for bringing said ends in alignment with themselves and for subjecting them to a strong flapping or whipping, so that their fibres are opened and separated while removing the original twist and causing consequent parallel arrangement of the fibres.

The lateral pretreating nozzles are oriented with their axes in such a way that the jets of air leaving them hit and intersect the ends of the threads in the portion extending between the mixing chamber and the respective cutting member. In the embodiment shown in FIGS. 6 and 7 the axes of the nozzles 29 and 30 are substantially parallel to the longitudinal axis of the mixing chamber 14, so that the jets of air leaving these nozzles substantially hit the end portions of the ends of the threads.

It is however also possible to differently direct these nozzles such that the jets of air leaving them hit the ends of the threads at a middle point between the outlet of the mixing chamber 14 and the cutting members. FIG. 8 shows such an arrangement of the nozzles, indicated at 29*a* and 30*a*, and from this Figure it will be seen that the axes of these nozzles are directed upwards even if they substantially intersect also in this case the straight lines connecting the lateral outlets of the mixing chamber 14 with the respective cutting members 26 in position ready for cutting.

For influencing and increasing the action of the jets of air onto the ends of the threads considering also the specific characteristics of the threads to be treated, it is possible to provide adjacent the sides of the body 13 in which there is defined the mixing chamber 14 nozzles of different cross section and/or more than one nozzle. Some of these possibilities are shown in FIGS. 9 to 14.

Figure 9:
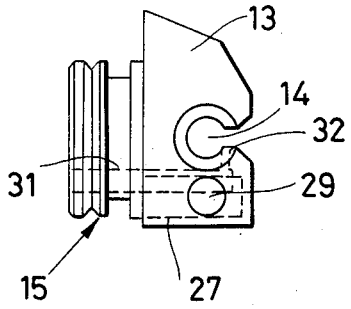
Figure 10:
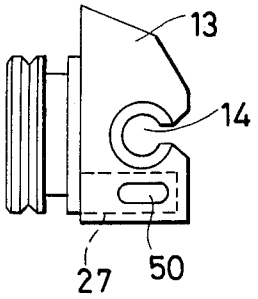
Figure 11:
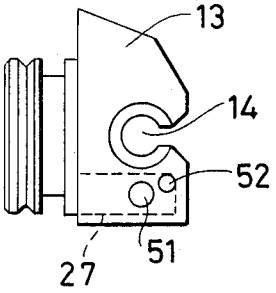
Figure 12:
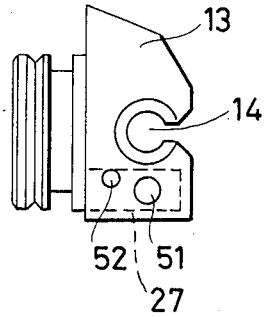
Figure 13:
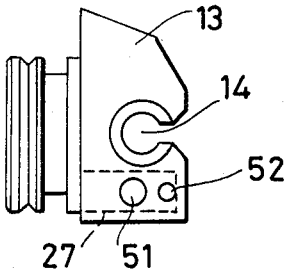
Figure 14:
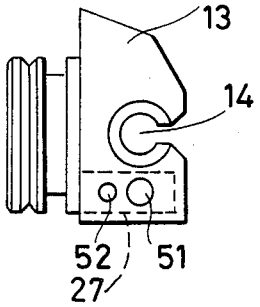

FIG. 9 shows a body 13 with a single lateral nozzle 29 having circular cross section, while FIG. 10 shows an identical body 13 having however a lateral nozzle 50 with oval cross section. In FIGS. 11 to 14 there are shown bodies 13 which besides presenting a main circular nozzle 51 also have a secondary nozzle 52 with a circular cross section less than that of the main nozzle. The difference between the embodiments shown in FIGS. 11 to 14 simply lies in the different mutual arrangement of the main and secondary nozzles.

It is not necessary that the form and/or arrangement of the pretreating nozzle or nozzles in the region of one side of the body 13 are identical to those at the opposite side: on the contrary, it might be preferable to choose different forms and/or arrangements of nozzles at the two sides of the body 13 considering the twist of the threads.

In the case of provision of a main nozzle and a secondary nozzle the axis of the latter may also be slightly inclined with respect to the axis of the main nozzle.

In FIGS. 9 to 14 there are shown bodies 13 with respective mixing chambers 14 which all have the same form, but it is obviously possible to adopt mixing chambers having different forms according to the characteristics of the threads to be spliced. In this case provision may be made for arranging for each type of thread a specific body 13 with the mixing chamber and with pretreating nozzles more suitable for the characteristics of the respective type of thread. Thanks to the easy interchangeability of the body 13 alone, it is therefore made possible to rapidly adapt the splicing apparatus to most various requirements.

There may also be provided the possibility of adjusting the flow of compressed air intended to feed the pretreating nozzles. To this purpose it would be possible to insert for instance into the channel 42, which departs from the first valve 37, a throttle valve adjustable from outside, such as to vary the flow rate of compressed air delivered to the pretreating nozzles according to the requirements.

With reference to FIGS. 15 to 22 a block or cap 112 of the apparatus for splicing textile threads arranged between two support plates carries a body 113 in which there is defined the mixing chamber 114. The two threads to be spliced are indicated at A and B.

In FIG. 15 the two threads A and B, which are initially inserted into the apparatus parallel to one another from the same side such as to be located at both sides of the body 113, are shown already crossing each other in the mixing chamber 114 by means of known crossing members 123, clamped by resilient clamping members 124, guided by positioning members 126*a* and ready for being cut by cutting members 126.

For pretreating the ends of the threads A and B prior to their splicing by means of compressed air in the mixing chamber there are provided, at the two sides of the body 113, nozzles which can be supplied with compressed air for delivering jets of air directed such as to substantially intersect the straight lines connecting the lateral outlets of the mixing chamber with the respective cutting members 126 in position ready for cutting.

For this purpose the body 113 in which there is defined the mixing chamber 114 is provided in its lower part with lateral dead bores 127 and 128 having parallel axes which are perpendicular to the longitudinal axis of the chamber 114, the bores 127, 128 being connectable, at a suitable moment, through a corresponding valve not shown, with a fitting 134 connected to a source of compressed air.

In the same body 113, that is in the central part thereof, there is provided a further dead bore 131 for supplying compressed air into the mixing chamber 114, and also this bore 131 is put into communication, at a suitable moment, through a further valve not shown, with the fitting 134.

In the embodiment shown in FIGS. 15 to 18, from each of the bores 127 and 128 there extends laterally a bore 129*a*, respectively 130*a*, these bores freely opening at the respective sides of the body 113 and defining the pretreating nozzles for the ends of the threads A and B. As visible in FIGS. 15 and 16, the axes of the nozzle-like bores 129*a* and 130*a* are directed upwards.

In this embodiment there are provided means for conditioning the jets of compressed air leaving the nozzles 129*a* and 130*a*, said means being located outside of the nozzles themselves. Specifically, in the case shown in FIGS. 15 to 18, these means comprise two semicylindrical walls 160 and 161 arranged at the two sides of the body 113 at a given distance from the outlets of the respective nozzles 129*a* and 130*a*, said walls delimiting channels which are frontally open and coaxial with their axes parallel to the axis of the mixing chamber 114 (see particularly FIGS. 17 and 18). It is to be pointed out that the upwards inclined axes of the nozzles 129*a*, respectively 130*a*, obliquely intersect the respective semicylindrical walls 160 and 161. The jets of compressed air which leave the nozzles 129*a* and 130*a* therefore hit the semicylindrical walls 160, respectively 161, and thus inside the open channels delimited by the semicylindrical walls there is imparted to the jets a whirling rotational motion the sense of which is determined by the impact direction of the jets of air against the semicylindrical walls. This rotational direction is to be chosen such as to be contrary to the twist direction of the thread whose end has to be pretreated with the jet of air, so as to remove the original twist in the end portion of the thread during the pretreating step and obtain a complete opening and parallelization of the fibres, as visible in FIGS. 16 and 18, which just show this pretreating step.

The channels delimited by said semicircular walls 160 and 161 and in which the ends of the threads become arranged during the pretreating step, while having the effect of imparting a rotational movement to the jets of air, do not enclose the ends of the threads, but leave the treatment to occur in a free and open environment.

Also in the further embodiment shown in FIGS. 19 to 22, in which the parts which are identical to those shown in FIGS. 15 to 18 are indicated by the same reference numbers, from each of the bores 127 and 128 there extends laterally a bore 129, respectively 130; these bores however do not directly define the pretreating nozzles for the ends of the threads A and B, but are connected to respective small tubes 162, 163, fastened to the sides of the body 113 with their axes substantially vertical. These small tubes 162, 163 define the pretreating nozzles and are oriented in such a way that their axes substantially intersect the straight lines connecting the lateral outlets of the chamber 114 with the respective cutting members 126 in the position ready for cutting. In this case the jets of air leaving the nozzles 162 and 163 hit the ends of the threads in a zone proximate to the outlet zone of the threads themselves from the mixing chamber 114.

In the latter embodiment there are provided inside the same nozzles 162 and 163 means for conditioning the jets of air. These means comprise, as visible in FIGS. 19 to 22, helical elements 164 and 165 respectively inserted in the nozzles 162 and 163 and effective to impart to the jets of air still inside the nozzles a movement having a rotational development. The jets of air thus leave the nozzles 162 and 163 already in form of whirling currents such as to hit in that form the free ends of the threads and carry out also in this case the function of removing the original twist from the threads and opening their fibres as well arranging them parallel to each other, as clearly visible in FIGS. 20 and 22.

It is pointed out that the choice of the conditioning means for the jets of air either on the outside or the inside of the pretreating nozzles is not connected to the specific form and arrangement of the nozzles themselves. In other words, the external means, as described with reference to the embodiment of the FIGS. 15 to 18, may also be adopted in the case in which the pretreating nozzles are not completely embodied in the body in which the mixing chamber is defined; it would also be possible to provide internal means of the type described with reference to the embodiment of FIGS. 19 to 22 inside nozzles composed of simple channels machined in said body and leading out of the same.

Even the possibility of suitably combining means internal of the nozzles with external conditioning means for obtaining an action combined in the desired sense is not to be excluded.

The device for pretreating the ends of the threads to be spliced according to the present invention has the main advantage that the ends of the threads to be treated have not to be brought into a well definite position within a circumscribed environment, as it occurs instead in the known devices, so that a greater security in carrying out the pretreatment is achieved. Furthermore, the device does not comprise additional component parts which could cause dimensional problems in the planning of the splicing apparatus.

In the case of conditioning the jets of air excellent pretreatment results are achieved for the ends of the threads to be spliced, in particular even in the case of greatly twisted threads or of threads having anyhow characteristics such as to make opening and parallelization of the fibres under the action of jets of air difficult.

We claim:

1. Apparatus for splicing ends of textile threads or yarns by means of compressed air comprising: a body defining a mixing chamber which has lateral outlets on opposite sides of the body; cutting means arranged at each of said sides of the body for cutting the threads or yarns to thereby provide free ends to be spliced; and means for dressing such free ends prior to splicing, by effecting opening and separation of the fibers of the threads or yarns, said dressing means including, at each of said sides of said body, at least one pretreating nozzle connectable through a valve with a source of compressed air to emit a jet of compressed air directed in a direction away from the respective side of said body and substantially intersecting a straight line connecting the respective lateral outlet of the mixing chamber with the respective cutting means when in position ready for cutting, whereby the free ends of the threads or yarns are dressed by a whipping effect, produced by currents of air, in free spaces at locations outside and adjacent said lateral outlets of said mixing chamber.

2. Apparatus according to claim 1, characterized in that said pretreating nozzles are defined by outlets of bores and channels at the sides of the body in which there is defined the mixing chamber, said bores and channels also being defined in said body.

3. Apparatus according to claim 2, characterized in that said bores open at the sides of said body below the lateral outlets of the mixing chamber.

4. Apparatus according to claim 2 including a block, characterized in that said body in which there is defined the mixing chamber and in which there are also defined said channels and bores opening laterally, is an interchangeable body mounted in an interchangeable manner in said block of the splicing apparatus, in said block there being arranged the control valve for supplying compressed air and there being defined feeding channels which communicate with the respective channels defined in said body when the interchangeable body is mounted in the block.

5. Apparatus according to claim 1 characterized in that at least at one side of the body in which there is defined the mixing chamber there are provided more than one pretreating nozzle.

6. Apparatus according to claim 5, characterized in that the plurality of nozzles comprise a main nozzle and a secondary nozzle.

7. Apparatus according to claim 6, characterized in that the secondary nozzle has a smaller cross section than the main nozzle.

8. Apparatus according to claim 6, characterized in that the axis of the secondary nozzle is inclined with respect to the axis of the main nozzle.

9. Apparatus according to claim 1, characterized in that the pretreating nozzles have a circular cross section.

10. Apparatus according to claim 1, characterized in that the nozzle or the nozzles at one side of the body in which there is defined the mixing chamber differ in their form and/or arrangement from those provided at the opposite side of said body.

11. Apparatus according to claim 1, characterized in that said valve for supplying compressed air to the pretreating nozzles is controlled to open either synchronously with the control of the cutting members for the free tails of the threads to be spliced or an instant prior to the control of said cutting members.

12. Apparatus according to claim 1, characterized in that between the valve for supplying compressed air and the pretreating nozzles there is inserted an adjustable throttle member.

13. Apparatus according to claim 1, characterized in that the axes of the pretreating nozzles are substantially parallel to the longitudinal axis of the mixing chamber.

14. Apparatus according to claim 1, characterized in that the axis of each pretreating nozzle and the longitudinal axis of the mixing chamber define when projected onto a vertical plane, an angle between 0° and 90°.

15. Apparatus according to claim 1, characterized in that the device for dressing the ends of the threads comprises means associated to said pretreating nozzles for conditioning the jets of air in order to impart to said jets a whirling movement with a rotational direction contrary to the twist of the thread intended to be hit by the jets of air.

16. Apparatus according to claim 15, characterized in that said means for conditioning the jets of air are arranged outside of the nozzles.

17. Apparatus according to claim 16, characterized in that said means for conditioning the jets of air comprise semicylindrical walls arranged at the two sides of the body in which there is defined the mixing chamber, the respective nozzles being oriented such that their axes obliquely intersect the respective semicylindrical wall which defines an open channel in which the pretreating step of the respective thread end occurs.

18. Apparatus according to claim 15, characterized in that said means for conditioning the jets of air are arranged internally of said nozzles.

19. Apparatus according to claim 18, characterized in that said means for conditioning the jets of air comprise helical elements arranged inside the nozzles.

20. Apparatus as in claim 1 wherein the pretreating nozzles have an oval cross-section.

* * * * *